United States Patent [19]

Ozawa et al.

[11] Patent Number: 5,008,713

[45] Date of Patent: Apr. 16, 1991

[54] SHEET CONVEYING APPARATUS AND SHEET CONVEYING METHOD

[75] Inventors: Takashi Ozawa, Ichikawa; Minoru Nada, Kawasaki, both of Japan

[73] Assignee: Canon Kabushiki Kaisha, Tokyo, Japan

[21] Appl. No.: 535,284

[22] Filed: Jun. 8, 1990

Related U.S. Application Data

[63] Continuation of Ser. No. 230,355, Aug. 10, 1988, abandoned.

[30] Foreign Application Priority Data

Aug. 12, 1987 [JP] Japan ..... 62-199960
Jul. 7, 1988 [JP] Japan ..... 63-170553

[51] Int. Cl.[5] ..... G03G 15/00; B65H 3/06

[52] U.S. Cl. ..... 355/319; 271/31; 271/37; 271/121

[58] Field of Search ..... 355/308, 309, 317–319, 355/321, 322, 23, 26; 271/3.1, 8.1, 10, 42, 37, 38, 121, 125, 151, 35

[56] References Cited

U.S. PATENT DOCUMENTS

| | | | |
|---|---|---|---|
| 4,074,902 | 2/1978 | Bradbury | 271/34 |
| 4,093,372 | 6/1978 | Guenther | 355/50 |
| 4,172,655 | 10/1979 | Wood | 355/26 |
| 4,365,794 | 12/1982 | Roller | 271/186 |
| 4,376,530 | 3/1983 | Akai | 271/10 |
| 4,458,890 | 7/1984 | Kawazu | 271/121 X |
| 4,473,789 | 9/1984 | Hildebrandt | 318/793 |
| 4,573,789 | 3/1986 | Wada | 355/319 |
| 4,621,921 | 11/1986 | Takahata et al. | 355/208 |
| 4,666,140 | 5/1987 | Godlewski | 271/125 X |
| 4,772,004 | 9/1988 | Golicz | 271/35 X |
| 4,777,498 | 10/1988 | Kasamura et al. | 346/150 |
| 4,873,547 | 10/1989 | Sasaki | 355/316 |

FOREIGN PATENT DOCUMENTS

| | | | |
|---|---|---|---|
| 2806696 | 10/1978 | Fed. Rep. of Germany . | |
| 3336820 | 5/1984 | Fed. Rep. of Germany . | |
| 57-4853 | 1/1982 | Japan . | |
| 60-28669 | 2/1985 | Japan . | |
| 61-159667 | 7/1986 | Japan | 355/322 |

*Primary Examiner*—Joan H. Pendegrass
*Attorney, Agent, or Firm*—Fitzpatrick, Cella, Harper & Scinto

[57] ABSTRACT

This specification discloses a sheet conveying apparatus having piling means for piling sheets with a predetermined amount of deviation in the direction of conveyance provided therebetween, first conveying means for imparting a conveying force to only that surface of the lead-off one of the sheets piled with the predetermined amount of deviation provided therebetween which is not in contact with the other sheets, and movement restricting means disposed upstream of the first conveying means by a distance shorter than the predetermined length of the conveyed predetermined sheet minus the predetermined amount of deviation for restricting the movement of the other sheets than the lead-off sheet. The specification also discloses a sheet conveying method characterized by the step of piling sheets successively with a predetermined amount of deviation in the direction of conveyance provided therebetween, imparting a conveying force in the direction of conveyance to the lead-off of the piled sheets, and conveying the other sheets than the lead-off sheet in the direction opposite to the direction of conveyance.

25 Claims, 16 Drawing Sheets

SHEET CONVEYING APPARATUS AND SHEET CONVEYING METHOD

This application is a continuation of application Ser. No. 230,355, filed Aug. 10, 1988, now abandoned.

BACKGROUND OF THE INVENTION

1. Field of the Invention

This invention relates to a sheet conveying apparatus and a sheet conveying method for separating a plurality of sheets piled for processing such as copying or character reading one by one and feeding them to a processing station.

2. Related Background Art

The apparatus or method of this type is used, for example, in an image forming apparatus or the like capable of forming images multiplexly on both or one surface of a sheet.

Heretofore, in a both-surface image forming apparatus, an intermediate tray for containing therein transfer materials having images formed on first surfaces thereof has generally been provided, and after the termination of the image formation on the first surfaces, the transfer materials piled in the intermediate tray have been separated one by one and fed out therefrom, and have been again conveyed to the image forming station to effect image formation on second surfaces of the transfer materials. An important point in effecting such both-surface image formation is the reliability of the conveyance of the transfer materials, that is, whether the conveyance of the transfer materials can be accomplished properly. Particularly, the problem is the reliability of the re-feeding operation of separating and feeding the transfer materials having images formed on the first surfaces thereof one by one from the intermediate tray.

FIG. 2 of the accompanying drawings shows an example of the both-surface image forming apparatus according to the prior art. In FIG. 2, the reference numeral 1 designates the image forming apparatus body, the reference numeral 2 denotes an original supporting table for supporting an original thereon, the reference numeral 3 designates a photosensitive drum bearing the image of the original, the reference numerals 4, 5, 6 and 7 denote mirrors for forming the image of the original on the photosensitive drum 3 and forming an electrostatic latent image thereon, and the reference numeral 8 designates an imaging lens. The reference numeral 9 denotes a primary charger for uniformly charging the photosensitive drum 3 before imaging, the reference numeral 10 designates a developing device for causing toner to adhere to the electrostatic latent image formed on the photosensitive drum 3 and developing the latent image into a toner image, the reference numeral 11 denotes a transfer electrode for causing the toner image formed on the photosensitive drum 3 to be transferred to a sheet, and the reference numeral 12 designates a cleaner for collecting the toner which has become unnecessary after the transfer.

One of sheets contained in a cassette 106 is taken out by a feed roller 107, is fed out by register rollers 109 at a predetermined timing synchronized with the image on the photosensitive drum 3, and has a toner image formed on a first surface thereof by the transfer electrode 11, whereafter the toner image is fixated by a fixating device 109. When an image is to be again superposedly formed on the same surface of the sheet having an image formed on the first surface thereof, the sheet is directed to a conveyance path 113*a* by a change-over guide 110 and is received into an intermediate tray 111.

Also, when an image is to be formed on a second surface of the sheet which is opposite to the first surface, the sheet is directed to a conveyance path 113*c* by the change-over guide 110 and is discharged to a half-way position by discharge rollers 117, whereafter the discharge rollers 117 are rotated in a reverse direction and the trailing end edge of the sheet is directed to a conveyance path 113*b* by the change-over guide, and the sheet is received into the intermediate tray 111.

Next, when copying is to be effected again on the first surface or on the second surface, sheets each having an image formed on the first surface thereof are re-fed one by one from the intermediate tray 111 and conveyed to the image forming station 107, and copying is effected on the second surfaces thereof. Here, it is sometimes the case with the sheets piled in the intermediate tray after copying has been effected on the first surfaces thereof that silicon oil adheres to the first surfaces thereof by the sheets passing through the fixating device 108 for the fixation of the toner image thereon or warp (curl) is created in the end portions of the sheets by heat or pressure applied thereto during the fixation. This may lead to the occurrence of duplex feed or jam during the re-feeding from the intermediate tray.

FIG. 3 of the accompanying drawings shows an example of a both-surface image forming apparatus constructed so as to enhance such reliability. This example of the prior art is designed such that each time a sheet is placed in the intermediate tray, the entire bundle of sheets placed in the intermediate tray is conveyed little by little by a pair of conveying rollers 114 and the sheets are piled in the form of a staircase in which the sheets deviate little by little from one another.

The group of sheets thus piled in the form of a staircase is collectively conveyed toward a pair of rollers 116 after the termination of the first surface image formation and as soon as the lowermost sheet leaves the pair of rollers 114, the pair of rollers 114 is stopped, whereby only the lowermost sheet nipped between the pair of rollers 116 at this time is conveyed by the pair of rollers 116 to thereby effect the second surface image formation. According to the present example of the prior art, it becomes possible to improve the duplex feed preventing performance during re-feeding.

The technique of piling sheets each having an image formed on one surface thereof in the form of a staircase and re-feeding them to form images on both surfaces of the image is described, for example, in U.S. Pat. Nos. 4,172,655 and 4,573,789.

However, in the above-described example of the prior art, when re-feeding is to be effected, there must be created a condition in which the lowermost sheet to be re-fed leaves the pair of rollers 114 and is nipped by only the pair of rollers 116 and the other sheets are nipped by only the pair of rollers 114. For that purpose, it is necessary to set the distance between the pair of rollers 114 and the pair of rollers 116 to a length slightly shorter than the length of the sheets. However, if the distance between the pair of rollers 114 and the pair of rollers 116 is fixed, sheets of a plurality of sizes cannot be re-fed.

Also, if sheets having images formed thereon are superposed one upon another or such sheets are separated and re-fed, silicon oil, toner, etc. adhering to the sheets rub against each other, and this has led to the problem that the sheets become stained.

SUMMARY OF THE INVENTION

The present invention solves the above-noted problems peculiar to the prior art.

It is an object of the present invention to provide a sheet conveying apparatus and a sheet conveying method capable of reliably piling, separating and re-feeding sheets of a plurality of sizes by a simple construction and in spite of being compact.

It is another object of the present invention to provide a sheet conveying apparatus and a sheet conveying method in which when a sheet is re-fed from piled sheets, the sheet can be prevented from being stained.

The construction of the present invention for achieving the above objects is sheet conveying means having piling means for piling sheets with a predetermined amount of deviation in the direction of conveyance provided therebetween, conveying means for imparting a conveying force to only that surface of the lead-off one of the sheets piled with the predetermined amount of deviation provided therebetween which is not in contact with the other sheets, and movement restricting means disposed upstream of said conveying means by a distance shorter than the predetermined length of a conveyed predetermined sheet minus said predetermined amount of deviation for restricting the movement of the other sheets than the lead-off one of the sheets.

The construction of the present invention for achieving the above objects is also a sheet conveying apparatus having piling means for piling sheets successively with a predetermined amount of deviation in the direction of conveyance provided therebetween, first conveying means for nipping the sheets piled with the predetermined amount of deviation provided therebetween and imparting a conveying force to the lead-off sheet, second conveying means capable of nipping and conveying the sheets piled by said piling means in forward and reverse directions between said piling means and said first conveying means, and control means for controlling said second conveying means so as to feed the sheets to said first conveying means, and convey the other sheets than the lead-off sheet in the reverse direction after the lead-off sheet has been liberated from its nipped condition.

Further, the construction of the present invention for achieving the above objects is a sheet conveying method characterized by piling sheets successively with a predetermined amount of deviation in the direction of conveyance provided therebetween, imparting a conveying force in the direction of conveyance to the lead-off one of the piled sheets, and conveying the other sheets than the lead-off sheet in the direction opposite to the direction of conveyance.

DESCRIPTION OF THE PREFERRED EMBODIMENTS

Figure 1:
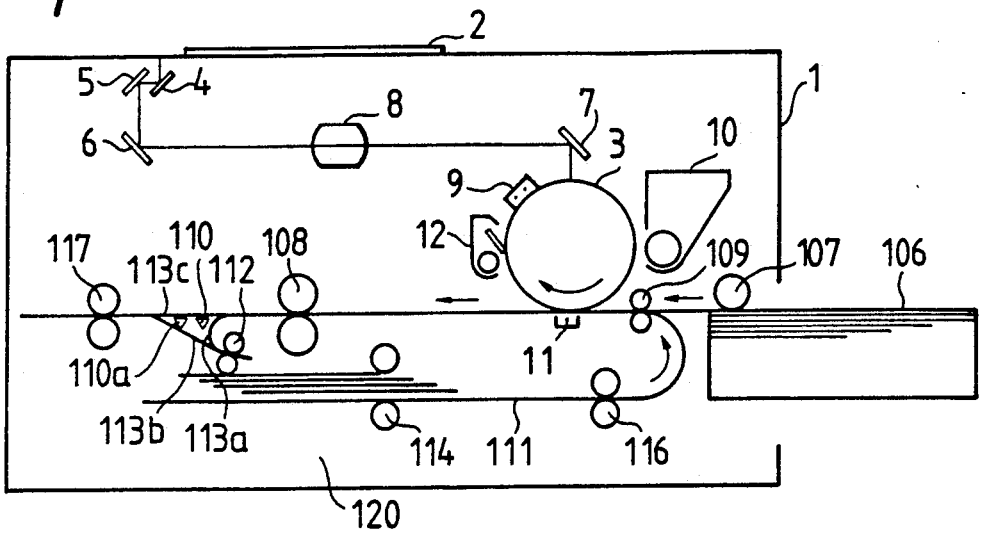
FIG. 1 is a cross-sectional view of an image forming apparatus embodying the present invention.
Figure 2:
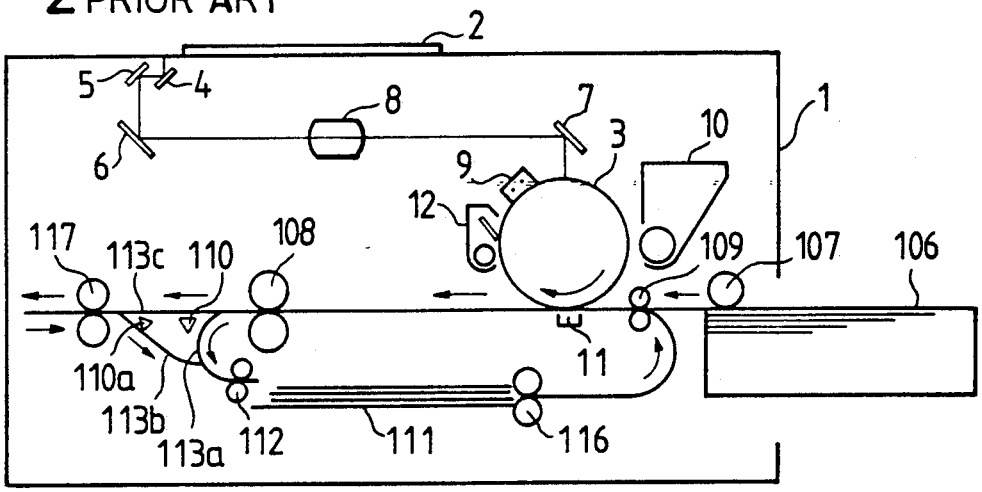
FIG. 2 PRIOR ART
FIGS. 2 and 3 s image forming apparatuses according to the prior art.

FIG. 1 is a cross-sectional view showing an embodiment of an image forming apparatus according to the present invention, that is, a copying apparatus capable of both-surface and multiplex copying in different colors.

Figure 3:
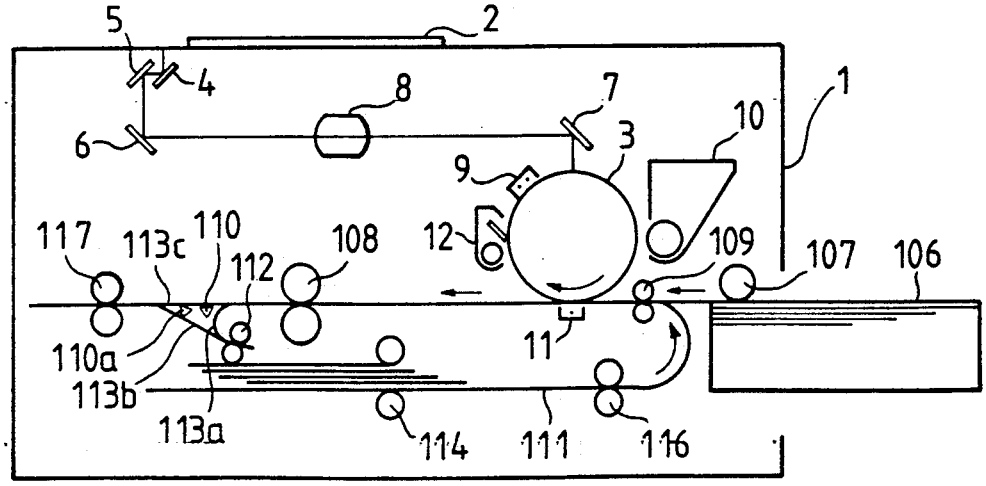
FIG. 3 PRIOR ART

In FIG. 1, members common to those in FIG. 3 are given similar reference numerals and need not be described. Also, the operation when both-surface or multiplex copying is effected for a sheet is the same as that of the example of the prior art shown in FIG. 3.

Figure 4:
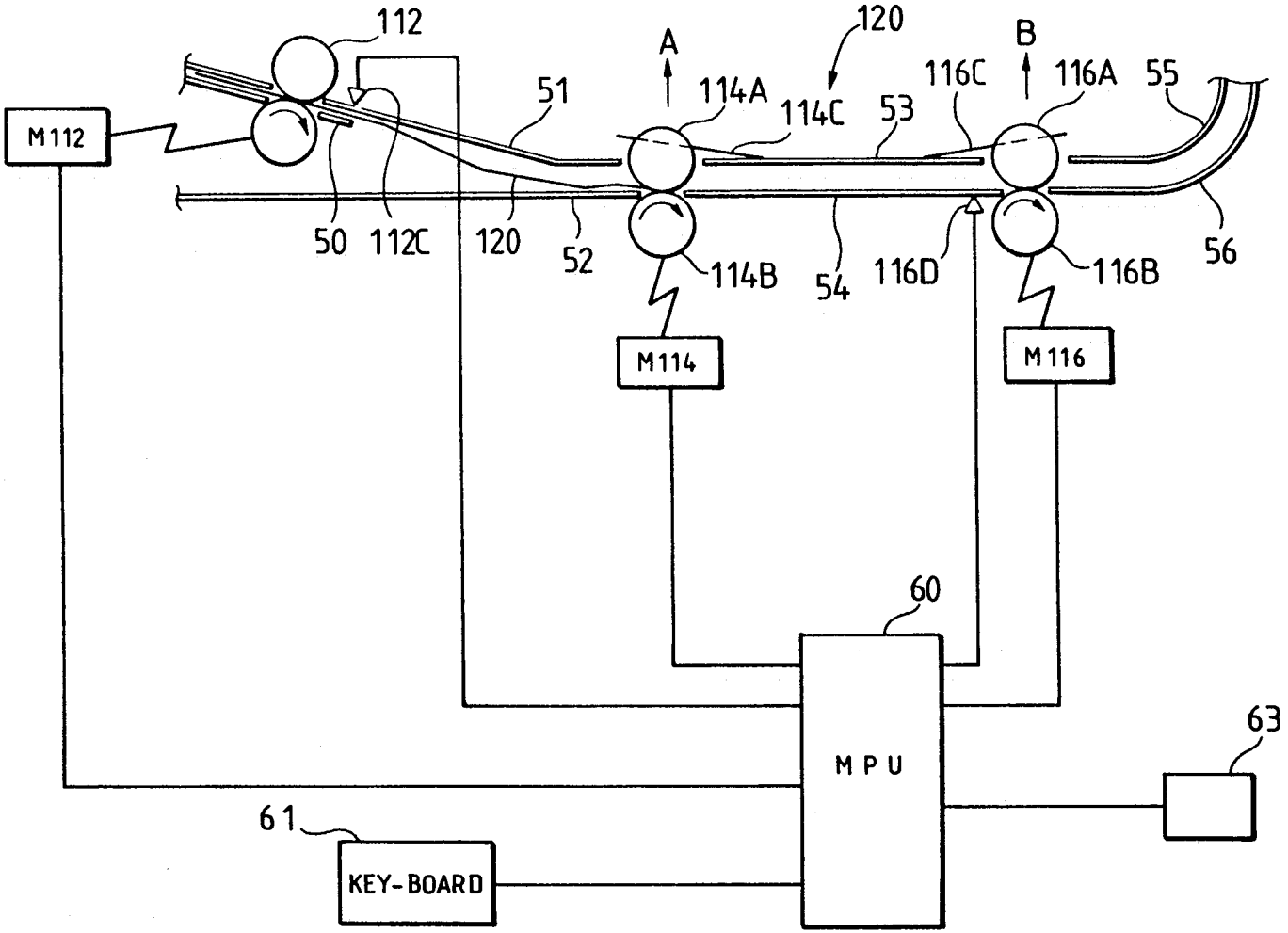
FIG. 4 is a block diagram of an embodiment of the present invention.

FIG. 4 is a control block diagram of rollers and sensors disposed in the re-feeding path 120 from the pair of rollers 112 of FIG. 1 to the pair of re-feed rollers 116 of FIG. 1.

In FIG. 4, the reference characters M112, M114 and M116 designate motors for driving the pair of rollers 112, the pair of rollers 114 and the pair of re-feed rollers 116, respectively. These motors are connected to the respective rollers by drive transmitting means such as gear trains, not shown. The motors M112, M114 and M116 are stepping motors, each of which is rotated by a predetermined angle in conformity with the number of pulses supplied from a control circuit 60 and is further controllable in forward and reverse rotations by the control circuit 60. The reference numeral 61 denotes a keyboard for designating the number of copies, the both-surface mode, the multiplex mode, etc. to the control circuit 60, and instructing the control circuit 60 to start copying.

The reference numerals 51, 52, 53, 54, 55 and 56 designate guides for guiding sheets.

Rollers 114A and 116A are supported in slots in a body side plate, not shown, and are movable in the directions of arrows A and B, respectively. Further, the rollers 114A and 116A are biased downward by leaf springs 114C and 116C, respectively.

Rollers 114B and 116B (drive side rollers) are rubber rollers, and the rollers 114A and 116A (follower side rollers) are made of synthetic resin whose coefficient of friction with respect to sheets is smaller than that of rubber.

The nips between the pair of rollers 114 and between the pair of rollers 116 are formed on the same plane as the guide members 52 and 55, and the surfaces of the rubber rollers 114B and 116B do not protrude onto the conveyance path. Designated by 112C and 116D are sensors for detecting the presence of a sheet.

Figure 5:
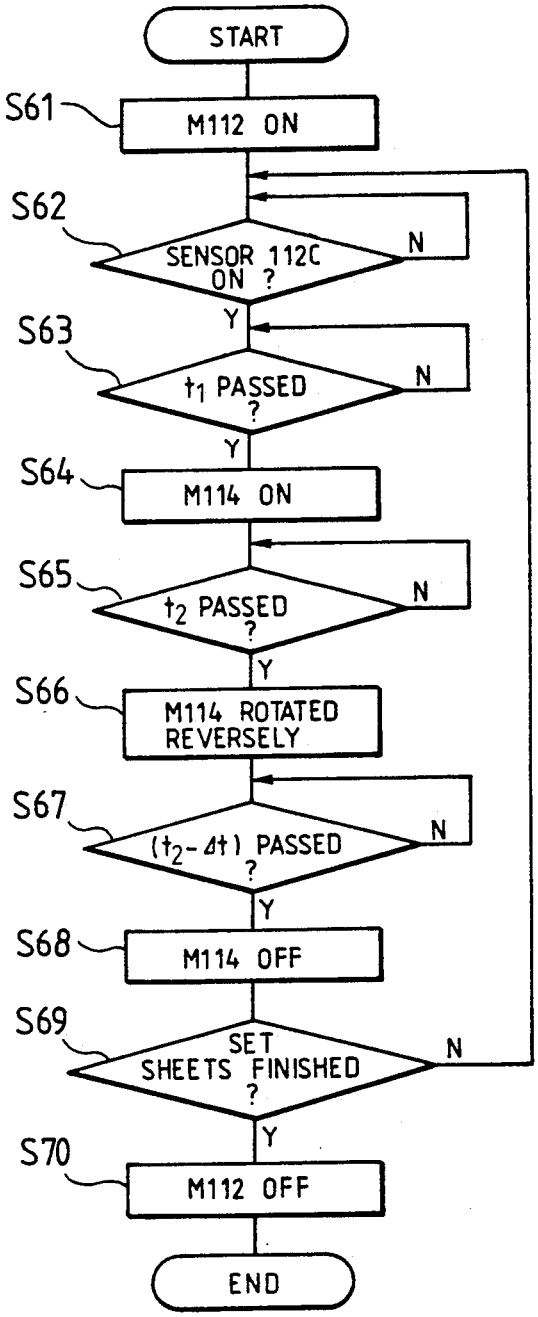
FIG. 5 is a flow chart of the embodiment of the present invention.

Reference is now had to the flow chart of FIG. 5 to describe the operation of containing a plurality of sheets in a re-feeding path 101.

When the both-surface or multiplex copy mode is set by the keyboard 61 and copy start is directed, a sheet taken out of a cassette 106 as previously described and having an image formed on one surface thereof by a photosensitive drum 3 is fed to rollers 112 which started rotating at step S61. After step S62 of FIG. 5, the leading end edge of the sheet is detected by the sensor 112C, the leading end edge of the sheet arrives at the nip between a pair of rollers 114 to form a loop, and after the lapse of a predetermined time $t_1$ necessary to make the leading end edge uniform, the motor M114 is started (step S64).

Figure 6:
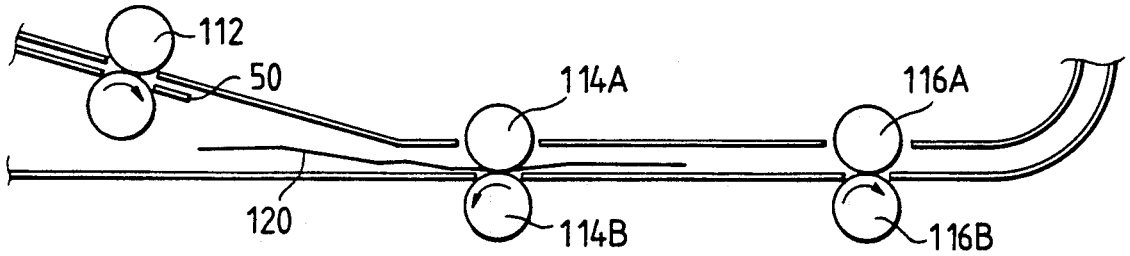
FIGS. 6, 7 and 8 illustrate the operation of the embodiment of the present invention.
Figure 7:
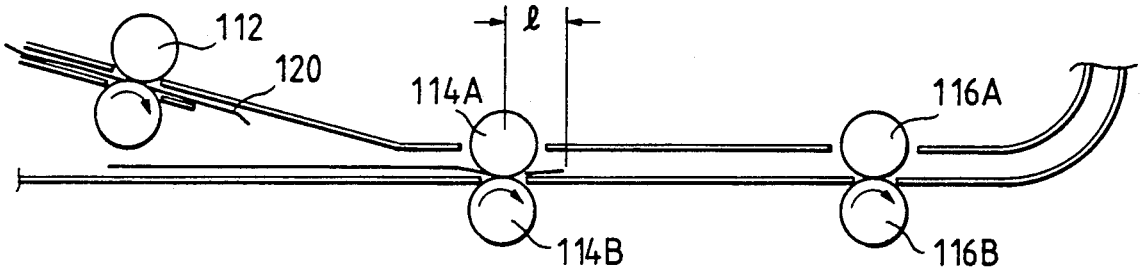

Then the motor M114 is rotated for a predetermined time $t_2$ necessary to convey the sheet by a preset predetermined distance $l_0$ after the sheet has been nipped between the pair of rollers 114 in order that the trailing end edge of the sheet may be pulled out from the pair of rollers 112 and the guide 50 (step S65 and FIG. 6), and after the lapse of the time $t_2$, the motor M114 is rotated reversely (step S66), and after the motor M114 is rotated reversely for a predetermined time $(t_2-\Delta t)$ shorter than the time $t_2$, the motor M114 is stopped (steps S67 and S68). By the reverse rotation of the motor M114, the sheet is conveyed in the reverse direction with the aid of the pair of rollers 114 and the leading end edge of the sheet comes to lie at a predetermined distance l downstream of the nip between the pair of rollers 114 (FIG. 7). The trailing end edge of the sheet is guided on the guide 52 and comes into position under the pair of rollers 112.

The rotation of the pair of rollers 114 can also be controlled by the number of pulses supplied from the control circuit to the motor M114. That is, the rotation of the pair of rollers 114 can likewise be controlled also by supplying a number of pulses corresponding to the angle of rotation of the motor M114 necessary to convey the sheet by a predetermined distance $l_0$ after the leading end edge of the sheet has arrived at the nip between the pair of rollers 114.

Next, at step S69, whether the piling of the set number of sheets preset by the keyboard 61 has been finished is judged, and if it is not finished, return is made to step S61. The next sheet is then conveyed and when it arrives at the pair of rollers 114, the pair of rollers 114 perform just the same operation as the last time while nipping the first sheet therebetween, and position the leading end edge of the second sheet at a distance l downstream of the nip between the pair of rollers 114. At this time, the first sheet is conveyed with the second sheet and the leading end edge of the first sheet lies at a distance l downstream of the leading end edge of the second sheet.

Figure 8:
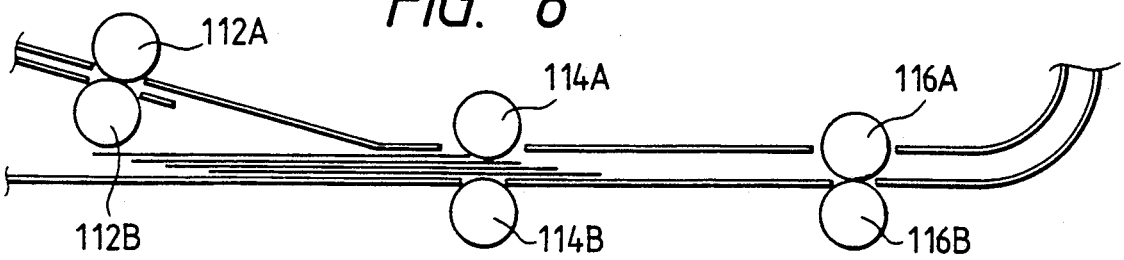

Thus, the two sheets are superposed one upon the other with a deviation of the distance l therebetween. By effecting this operation on the set number of sheets, the successive sheets can be piled with a deviation of the distance l therebetween as shown in FIG. 8.

In these processes, it is the roller 114A of slippery synthetic resin that protrudes into the conveyance path when the sheet strikes against the pair of rollers 114 and therefore, the leading end edge of the sheet can smoothly go into the nip between the pair of rollers 114.

The operation when piled sheets are re-fed for the second image formation during both-surface or multiplex copying will now be described with reference to the flow chart of FIG. 9.

Figure 10:
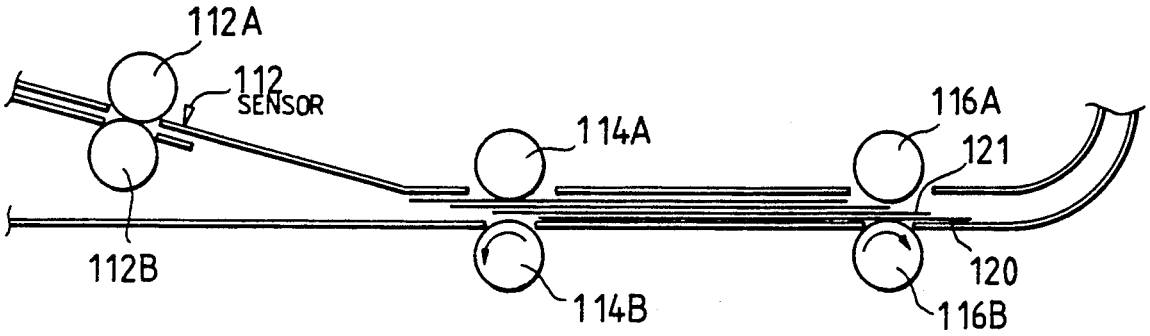
FIG. 10 illustrates the operation of the embodiment of the present invention.

When copy start is directed by means of the keyboard 61, rotation of the motors M114 and M116 is started and the piled sheets are successively fed to the pair of re-feed rollers 116 (steps S71 and S72). When the trailing end edge of the foremost sheet has passed between the pair of rollers 114, the motor M114 is rotated reversely (step S75)(FIG. 10). This timing is determined by the lapse of time (step S74) from after the leading end edge of the foremost sheet has been detected by the sensor 116D (step S73).

At this time, the several sheets from the lowermost sheet are nipped between the pair of rollers 116. Therefore, the distance between the pair of rollers 114 and the pair of rollers 116 is set to a value shorter than the length of the sheet minus the amount of deviation l. By the reverse rotation of the motor M114, the roller 114B is rotated reversely and the other sheets than the lowermost sheet are conveyed in the reverse direction because they are nipped between the pair of rollers 114, and are pulled out from the nip between the pair of rollers 116. Since the roller 116A is made of synthetic resin having a small coefficient of friction, the sheets are pulled out from the pair of rollers 116 without being damaged.

In contrast therewith, the lowermost sheet is in contact with the rubber roller of a great coefficient of friction which continues to rotate, and therefore is separated from the other sheets and conveyed to the downstream side. The motor M114 is stopped after the lapse of a predetermined time $t_4$ from after the start of its reverse rotation (steps S76 and S77), and the motor M116 is stopped after the lapse of a predetermined time $t_5$ from after the start of its rotation. The lowermost sheet is then conveyed to register rollers 109, whereupon the next image formation is effected. Whether the re-feeding of the set number of sheets has been finished is judged at step S710, and if it is not finished, return is made to step S71.

In such a construction, even if the spacing between the pairs of rollers is not varied, sheets of different sizes can be piled in the form of a staircase, separated and re-fed. That is, where sheets are piled in the form of a staircase, the time $t_2$ of the step S65 in the flow chart of FIG. 5 and the time $(t_2-\Delta t)$ of the step S67 can be changed in conformity with the length of a sheet in the direction of conveyance. To pull out the trailing end edge of the sheet from the pair of rollers 112, the time $t_2$ can be made longer for a longer sheet. Likewise, if the time $(t_2-\Delta t)$ is set in conformity with the length of a sheet, sheets of different sizes can be piled with a deviation of the distance l therebetween.

Figure 9:
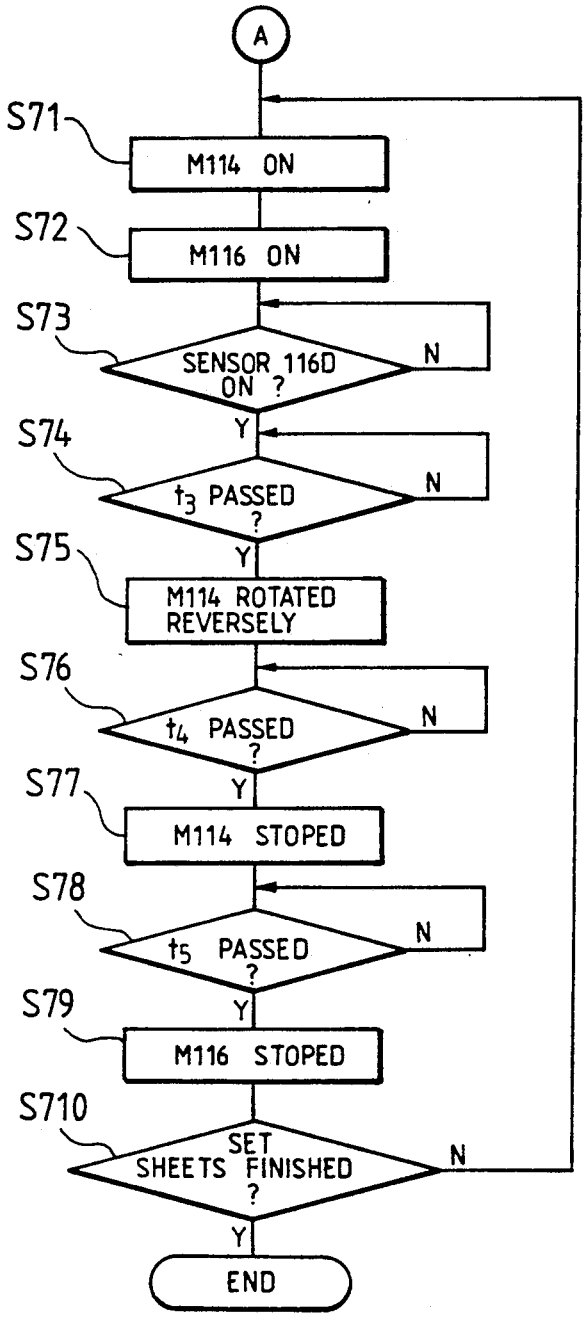
FIG. 9 is a flow chart of the sheet re-feeding in the embodiment of the present invention.

Also, when sheets are to be separated and re-fed, the times $t_3$, $t_4$ and $t_5$ of the flow chart of FIG. 9 are changed in conformity with the length of a sheet. The time $t_3$ is for the trailing end edge of the lowermost sheet to be pulled out from the pair of rollers 114 and therefore is set longer for a longer sheet. Likewise, the time $t_4$ is for an unfed sheet to be pulled out from the pair of rollers 116 and is set longer for a longer sheet.

The sizes of the sheets are detected by the sheet size detector 63 of FIG. 4, and the times $t_2$, $(t_2-\Delta t)$, $t_3$, $t_4$ and $t_5$ conforming to the detected sizes are calculated by MPU. The sheet size detector may be of the conventional type which detects sizes from cassettes, or of the type which detects sizes from the time required for a sheet to pass a sensor provided in the path of sheet conveyance.

Figure 11:
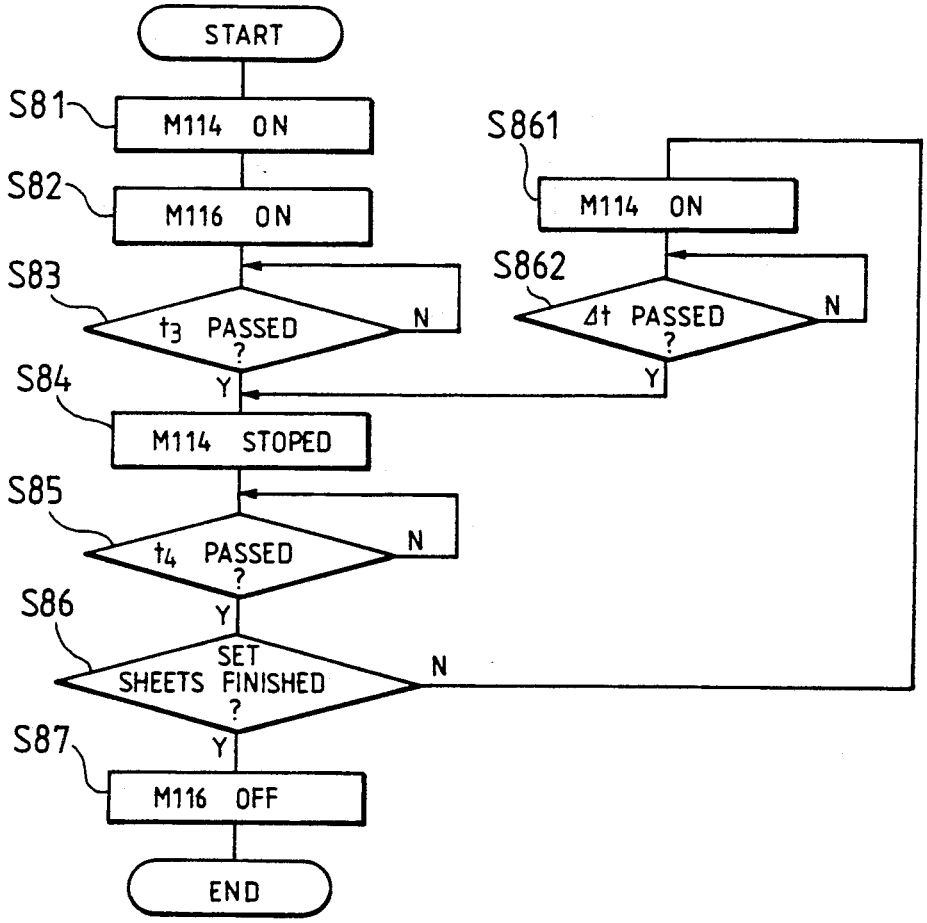
FIG. 11 is a flow chart of the sheet re-feeding.

Separation and re-feeding of sheets can also be accomplished simply by stopping the pair of rollers 114 at the step S75 of FIG. 9 (FIG. 11). That is, sheets not to be re-fed are stopped by being nipped between the pair of rollers 114, and only the lowermost sheet to be re-fed is conveyed by the drive roller 116B of rubber. At this time, however, the second sheet from the lowermost one is also nipped between the pair of rollers 116 and thus, the second sheet frictionally slides while that portion thereof which corresponds to the lower roller 116A is being urged against the lowermost sheet. If the image bearing surfaces of sheets face upward (both-surface copying), that portion of the back side of the second sheet which is nipped between the rollers will be stained. Also, if the image bearing surfaces of sheets face downward (multiplex copying), that portion of the image on the second sheet which is nipped between the rollers may disappear.

Figure 12A:
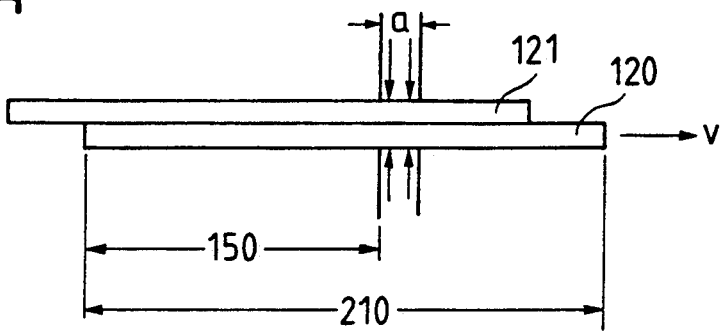
FIGS. 12, 13 and 14 illustrate the effect of the present invention.
Figure 12B:
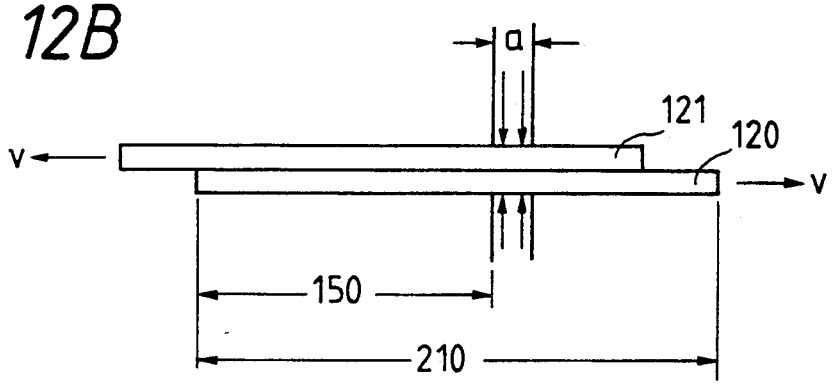

FIGS. 12A and 12B specifically show what has been described just above. FIG. 12A refers to a case where the second sheet 121 from the lowermost one is stopped, and FIG. 12B refers to a case where the second sheet 121 is pulled out.

In these figures, the area indicated by a shows the width of the nip portion between the pair of rollers 116, and the reference numerals 120 and 121 designate the lowermost sheet and the second sheet from the lowermost sheet, respectively. Also, the letter v shows the direction and velocity of movement of the sheet. Here, let it be assumed that the width a of the nip portion is 1 mm, the length of the sheet is 210 mm (the lateral length of the sheet of A4 size which is high in the frequency of use), and the distance from the nipped portion of the sheet 120 to the trailing end edge of the sheet is 150 mm. In FIG. 12A, a sheet of 150 mm passes the portion of the nip width 1 mm and therefore, the amount of frictional sliding in the area a is 150 $mm_2$ per unit width. Also, in FIG. 12B, assuming that the sheets 120 and 121 are being moved at the same velocity but in opposite directions, during the time that a point on the sheets passes the nip width, the relative position of the sheets deviates two times the nip width and therefore, the amount of deviation per unit width is 2 $mm_2$, and it is seen that this amount of sliding is only 1/75 of that in the case of FIG. 12A.

Thus, by effecting the simple control of once reversely feeding the second and subsequent sheets during re-feed, it becomes possible to prevent the sheets from being stained.

Also, in the above-described embodiments, description has been made with respect to a case where as soon as the bundle of sheets assumes the state shown in FIG. 10, the roller 114B is rotated reversely, whereas this is not restrictive, but a sufficient effect can be achieved even if a certain degree of time deviation is provided.

Reference is now had to the simple model views of FIGS. 13 and 14 to consider in detail the creation of stains resulting from the above-described frictional contact between the sheets.

Figure 13A:
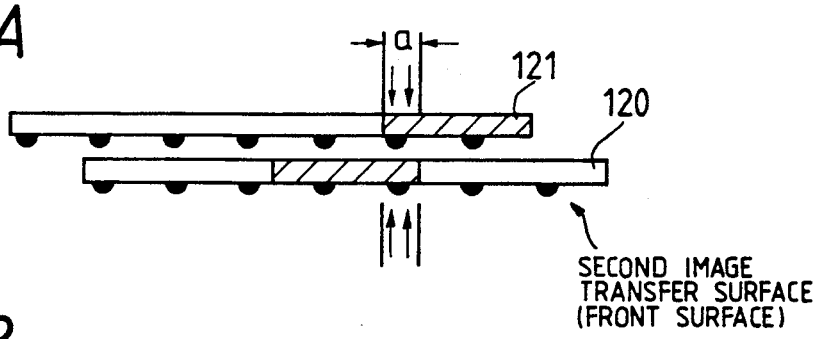
Figure 13B:
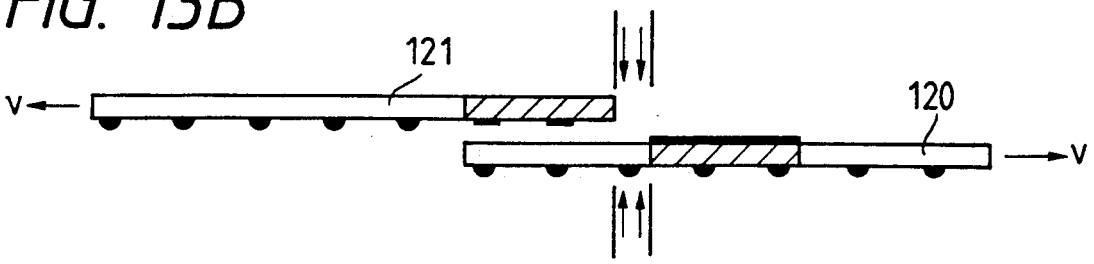

Referring to FIGS. 13A and 13B which are model views showing the state during multiplex copying, black spots indicate groups of toner particles of an image. When at the timing of re-feed, the sheets 120 and 121 are simultaneously fed forwardly and reversely, respectively, as previously described, the portions of the sheets which are within the range of the hatching frictionally contact with each other at the nip portion. At this time, the toner particles on the sheet 121 peel off and adhere to the back surface of the sheet 120 (if the second image transfer surface is the front surface) (FIG. 13B).

Figure 14A:
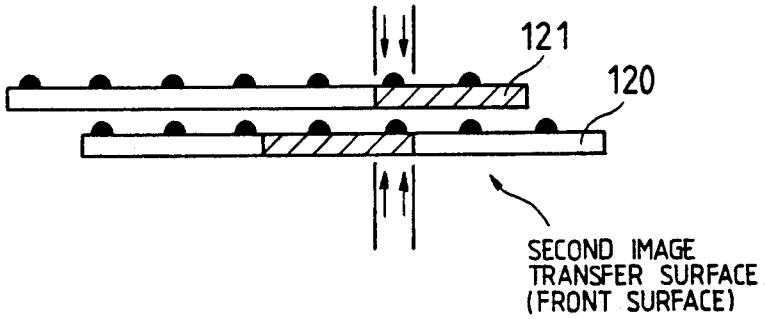
Figure 14B:
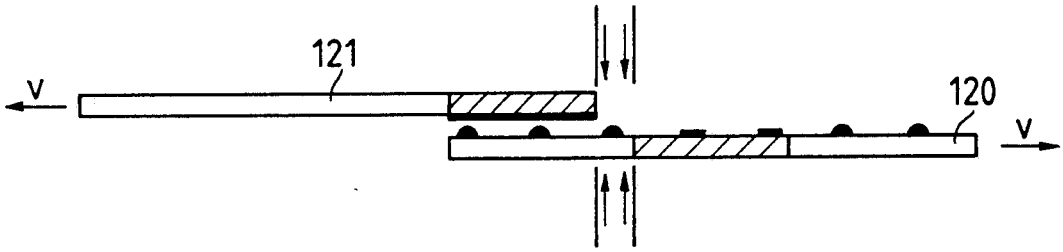

FIGS. 14A and 14B are model views showing the state during both-surface copying. When at the timing of re-feed, the sheets 120 and 121 are simultaneously fed forwardly and reversely, respectively, the portions of the sheets which are within the range of the hatching frictionally contact with each other, and the toner particles on the back surface of the sheet 120 (the first transfer image) peel off and adhere to the front surface of the sheet 121. This toner adherence, i.e., stains, during multiplex copying and both-surface copying are greatly decreased and improved by the aforedescribed control of once reversely feeding the second and subsequent sheets. However, further improvement can be easily realized by the control which will hereinafter be described.

Figure 14C:
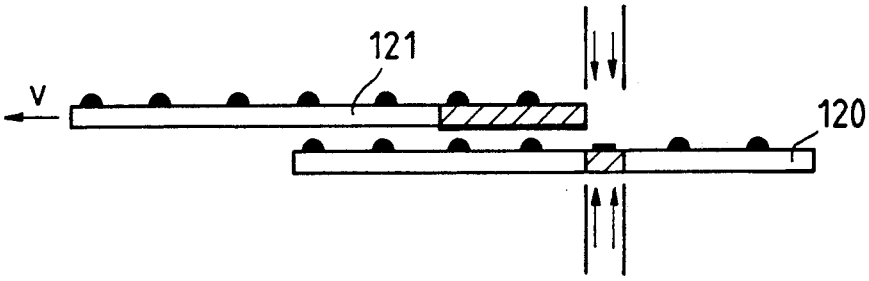

The above-described stains during both-surface copying and multiplex copying, particularly, the stains during both-surface copying, adhere to the second image transfer surface and therefore, the necessity of further decreasing such stains is high. So, the control during both-surface copying is changed as shown in FIG. 14C. That is, the sheet 121 is fed reversely in advance at the velocity v and, when it has passed through the nip portion, forward feeding of the sheet 120 is started. As a result, toner particles peeling from the sheet 120 are confined to a slight range indicated by hatching, and toner particles, i.e., stains, adhering to the sheet 121 can be greatly decreased.

Figure 15:
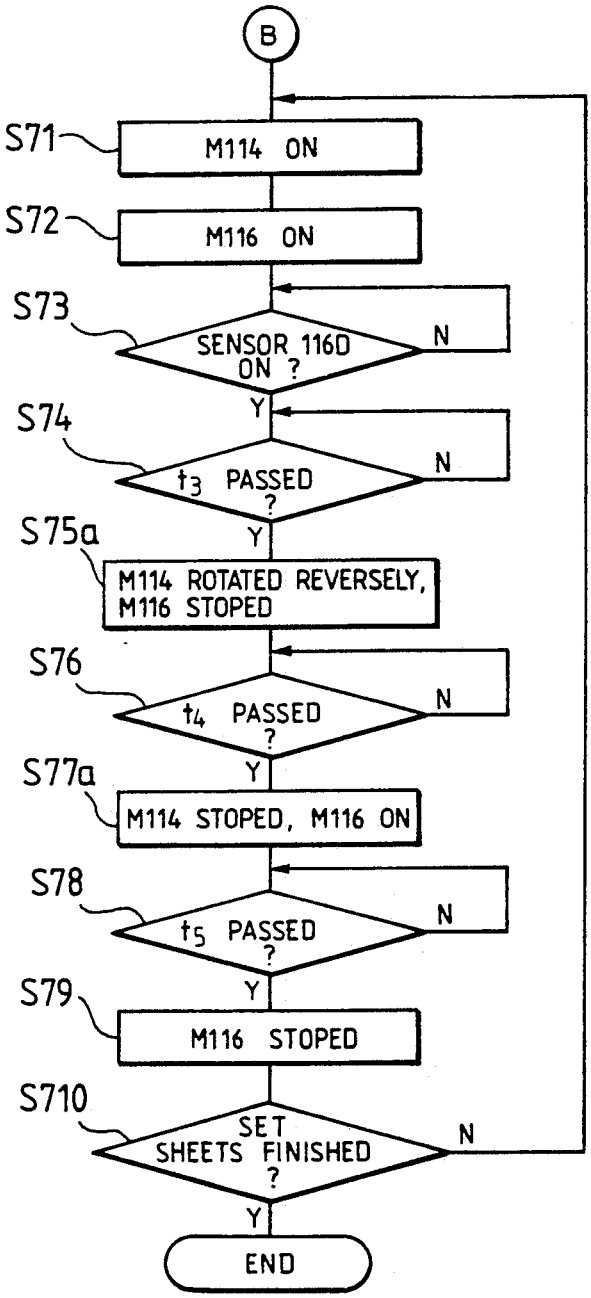
FIG. 15 is a flow chart of the sheet re-feeding.

FIG. 15 shows a flow chart of the above-described embodiment. At step S75*a*, the motor M116 is stopped and the motor M114 is rotated reversely to feed the second and subsequent sheets reversely in advance. When the time $t_4$ required for the second and subsequent sheets to pass through the nip portion has elapsed, the motor M114 is stopped and the motor M116 is restarted. The operations of the motors M114 and M116 at steps S75*a* and S77*a* need not always be simultaneous.

Figure 16:
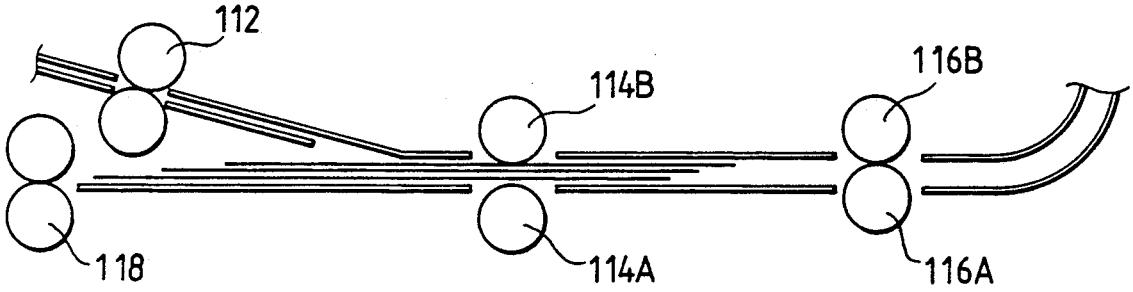
FIG. 16 shows a second embodiment of the present invention.

Further, in the above-described embodiment, description has been made with respect to a case where the lowermost sheet on the intermediate tray 111 is first placed and is first re-fed. However, the present invention can also be readily applied in a case where, as shown in FIG. 16, the uppermost sheet on the intermediate tray (the sheet on which the operation for the first surface has been effected last) is first placed and is first re-fed.

Figure 17:
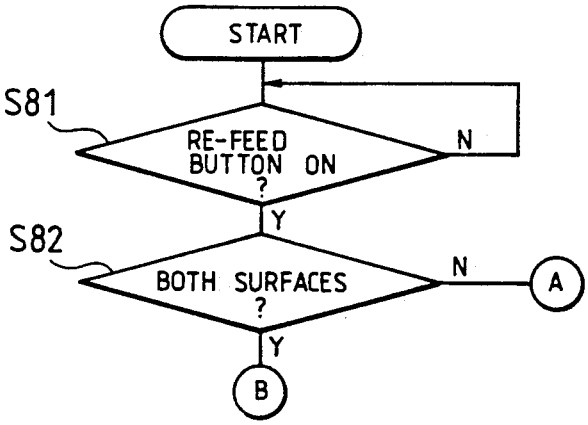
FIG. 17 is a flow chart of the sheet re-feeding.

FIG. 17 is a flow chart showing the control in a case where the present invention is applied to a copying apparatus capable of both-surface copying and multiplex copying.

At step S81, it is judged that a button on the keyboard 61 for effecting the command of predetermined re-feed has been depressed, whereafter at step S82, whether the designated mode is the both-surface copying mode or the multiplex copying mode is discriminated. In the case of the multiplex copying mode, the control described in connection with FIG. 9 is suitable and therefore, jump is made to step S71, whereafter control is effected in accordance with the flow chart of FIG. 9. In the case of the both-surface copying mode, the control of FIG. 15 is suitable and therefore, jump is made to the step S71 of FIG. 15.

Figure 18:
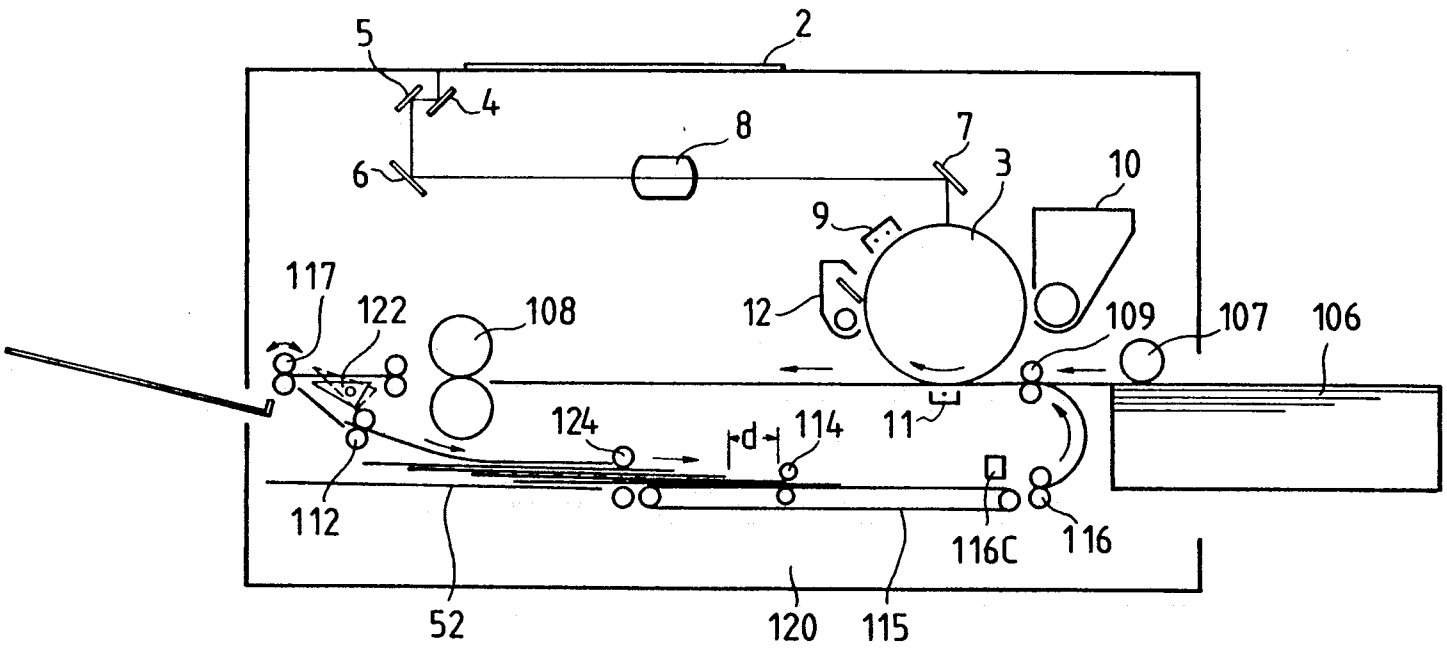
FIG. 18 is a cross-sectional view showing a third embodiment of the present invention.

FIG. 18 shows an image forming apparatus to which the present invention is applied as another embodiment thereof. In FIG. 18, members similar to those in FIG. 1 are given similar reference numerals and need not be described. In FIG. 18, the reference numeral 122 designates a change-over guide for changing over whether sheets passing between fixating rollers 108 should be fed to discharge rollers 117 or to a pair of rollers 112. The change-over guide 122 also serves to guide sheets switched back by the discharge rollers 117 during both-surface copying to the pair of rollers 112. The reference numeral 115 denotes a belt for conveying sheets. The reference numeral 124 designates a pair of rollers for piling sheets with a predetermined amount of deviation provided therebetween.

Figure 19:
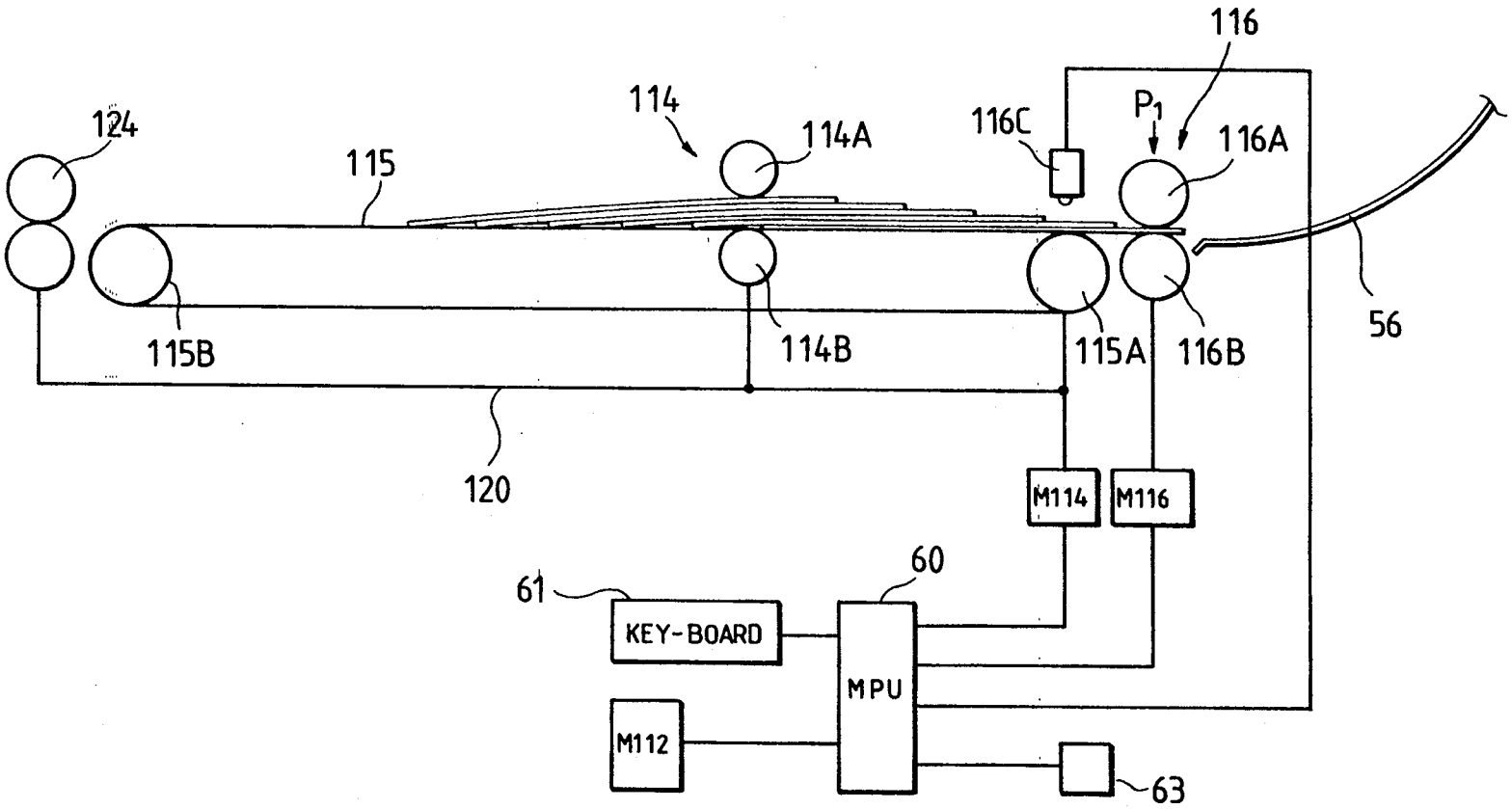
FIG. 19 is a block diagram of the third embodiment of the present invention.
Figure 20:
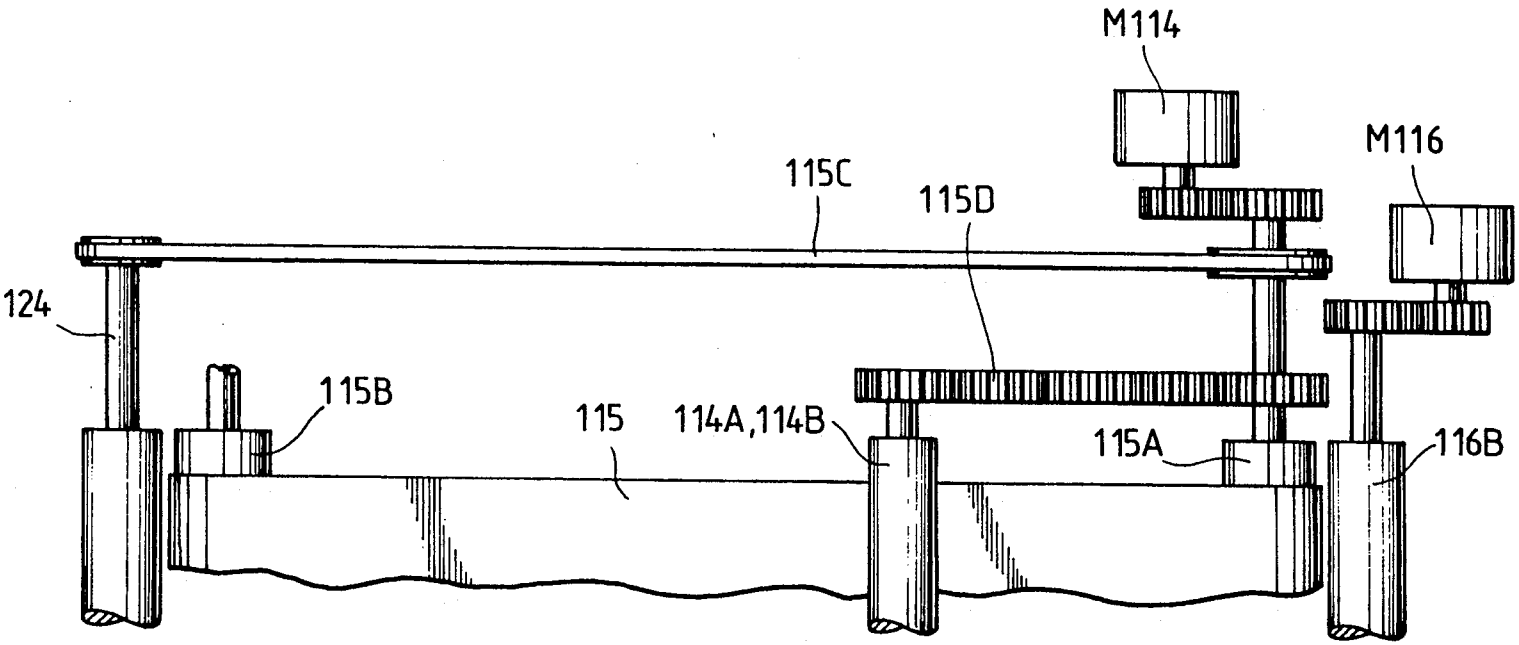
FIG. 20 is a plan view of the third embodiment of the present invention.

FIG. 19 shows the re-feeding path 120 of FIG. 18, and in FIG. 19, members similar to those in FIG. 14 are given similar reference characters and need not be described. FIG. 20 is a fragmentary plan view corresponding to FIG. 19.

Referring to FIGS. 19 and 20, the belt 115 is passed over pulleys 115A and 115B. The pulley 115A and pairs of rollers 114 and 124 are driven by a common stepping motor M114. The drive force of the stepping motor M114 is transmitted to the pair of rollers 124 through a belt 115C, and is also transmitted to the pair of rollers 114 through a gear train 115D.

In such a construction, to pile sheets with a predetermined amount of deviation provided therebetween, the motors M112 and M114 can be controlled in accordance with the flow chart shown in FIG. 5. At this time, the pair of rollers 124 perform the function of the pair of rollers 114 in FIG. 1.

Sheets each having an image formed on the first surface thereof in this manner are successively piled on an intermediate tray as a supporting and conveying means by the pair of rollers 124. The intermediate tray is formed by the belt 115 passed over the pulleys 115A and 115B. The pulley 115A is driven by the stepping motor M114, whereby the belt 115 can be moved and stopped independently of the other driving systems (sheet feed driving, drum driving, etc.).

Detecting means 116C such as an optical sensor for detecting the leading end edges of sheets conveyed by the belt 115 is disposed just above the pulley 115A. In the apparatus of the present embodiment, sheets of various lateral lengths can be piled and fed, and the control circuit 60 recognizes the lengths of the sheets by input means 63. Also, a pair of conveying rollers 116 for nipping a sheet therebetween and re-conveying it to an image forming station are disposed forwardly of and near the right-hand pulley 115A.

In the apparatus of the present embodiment, a sheet $S_1$ piled earlier is more shifted forwardly in the direction of conveyance than the next sheets $S_2$ and $S_3$, and in this case, the lower roller 116B of the pair of conveying rollers is the drive side roller, and the upper roller 116A is the follower side roller rotatably urged against the roller 116B with a force $P_1$. As shown in FIG. 20, the drive side roller 116B has connected thereto an exclusive motor M116 so that it is driven only during a predetermined re-feeding period. A guide plate 56 for guiding sheets to the image forming station is provided rightwardly of the pair of conveying rollers 116.

Also, a pair of conveyance blocking rollers 114 as conveyance blocking means urged with a force $P_2$ against sheets piled at a distance l rearwardly of the nip between the pair of conveying rollers 116 are disposed intermediately of the belt 115. The roller 114B is connected to the pulley 115A by a gear train and is driven at the same peripheral speed by the motor M114 (FIG. 20). Said distance l is set at a position immediately rearward (e.g. 3–10 mm rearward) of the lead-off sheet $S_1$ when the leading end edge of the sheet $S_1$ has arrived at the nip between the conveying rollers 116.

Where there are various kinds of sheets and the lengths thereof differ, said distance l is set on the basis of the shortest sheet. More specifically, the letter size sheet is 216 mm, the A4 size sheet is 210 mm and the B5 size sheet is 182 mm, and if the B5 size is the smallest size, l is set, for example, to $l=175$ mm. Immediately after the detecting means 116C has detected that the lead-off sheet $S_1$ has passed the position of the pair of conveyance blocking rollers 114, the motor M114 is stopped and a brake is applied so that the belt and the pair of rollers are not idly rotated by the conveying force $P_1\mu_1$ at the pair of conveying rollers 116 which will hereinafter be described.

In the present embodiment, the motor M114 is a stepping motor and therefore, a predetermined brake force can be easily produced by stopping the motor M114 in its energized condition (generally, even in a DC motor system, the drive system includes a reduction gear train and therefore a brake force can be secured for only the loads of the motor itself and the belt or the like during the idle rotation of the rollers).

The relation between the pressure forces in the respective pairs of rollers will now be described. When the coefficient of friction between the conveying roller 116B and a sheet is $\mu_1$, and the coefficient of friction between the belt and a sheet is $\mu_2$, and the coefficient of friction between sheets is $\mu_3$, the pressure forces $P_1$ and $P_2$ between the respective pairs of rollers are set in the relation that $$P_2\mu_2 > P_1\mu_1 > P_1\mu_3. \quad (1)$$

Usually, the belt and the rollers are made of a material such as rubber and therefore, $\mu_1$, $\mu_2 > 1$ and $\mu_3 \approx 0.5$. Accordingly, if the materials of the belt and the rollers are set to the same material, the relation of expression (1) above can be readily realized by pressing with $P_2 > P_1$.

Figure 21:
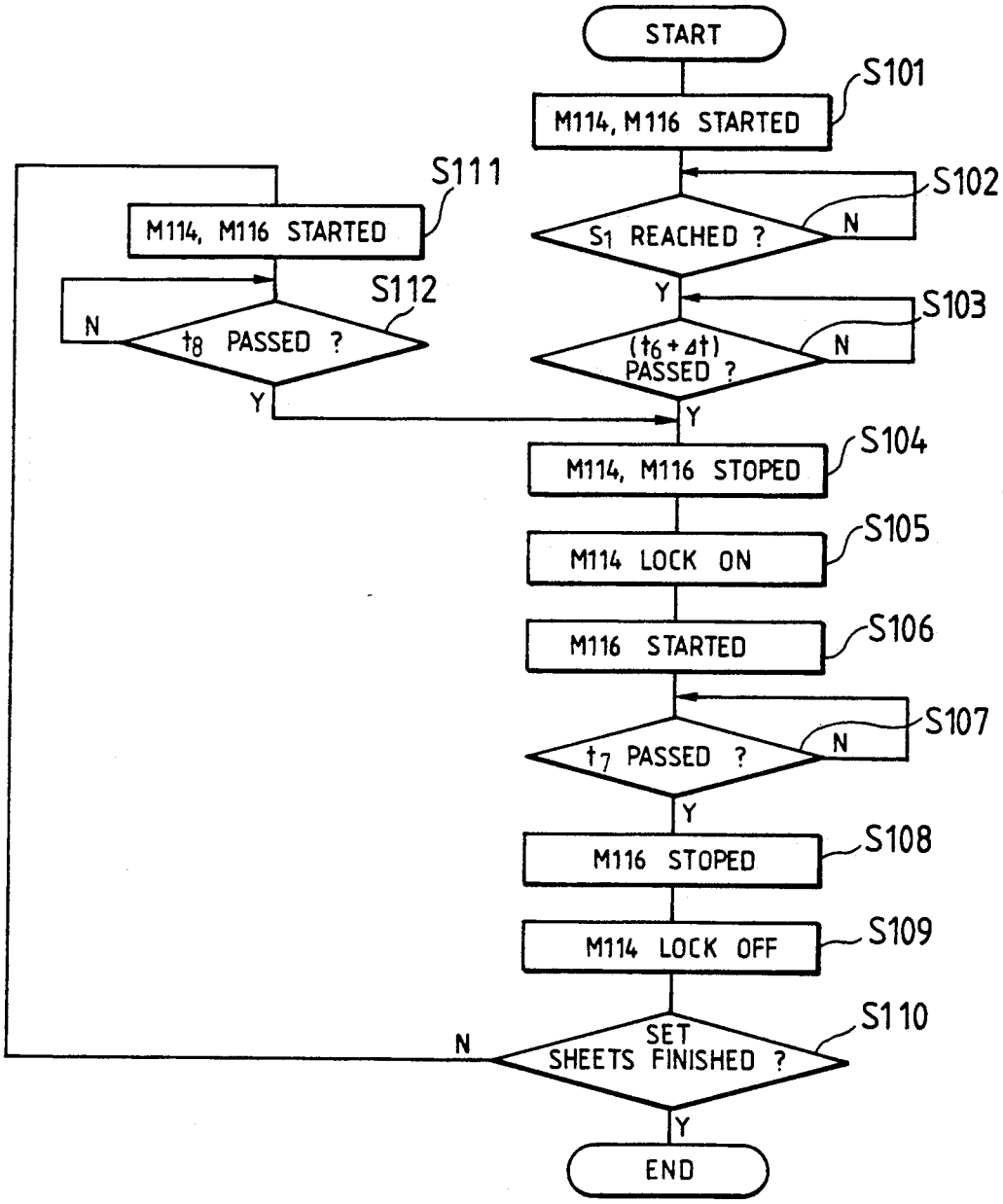
FIG. 21 is a flow chart of the third embodiment of the present invention.

Reference is now had to the flow chart of FIG. 21 to describe the operation of the apparatus of the present embodiment as described above, with respect to a case where the length of the sheet is smallest.

A plurality of sheets $S_1$, $S_2$, $S_3$, . . . are set back by a spacing d by the aforedescribed method and are successively piled and conveyed on the belt 115 on the side opposite to the drive side roller 116B of the aforedescribed pair of conveying rollers, and are nipped between the pair of conveyance blocking rollers 114 with the belt interposed therebetween. When in this state, a start signal is input from the keyboard 61, the sheets are further conveyed (step S101) and the leading end edge of the lead-off sheet $S_1$, i.e., the leading end edge of the lowermost sheet, is detected by the optical sensor 116C (step S102). The leading end edge of that sheet is nipped between the pair of conveying rollers 116 being rotated at the same peripheral speed as the peripheral speed of the belt, and in accordance with the pre-recognized sheet length and the positional relation between the optical sensor and the pair of conveying rollers, the driving of the belt 115 and the pair of conveying rollers 116 is stopped at a point of time whereat the trailing end edge of the lead-off sheet $S_1$ has passed between the pair of conveyance blocking rollers 114 ($(t_6+\Delta t)$, but in this case, $\Delta t=0$ because of the smallest sheet), and the motor M114 becomes braked (the movement of the belt and the pair of conveyance blocking rollers 114 is locked) (steps S103, S104 and S105).

Next, the sheets $S_1$, $S_2$, $S_3$, . . . are successively conveyed in conformity with the timing of the both-surface or multiplex copying. First, in order to feed only the lead-off sheet $S_1$ to the image forming station, only the conveying roller 116B is started by the exclusive motor M116 at predetermined timing with the belt 115 remaining stopped (step S106). At this time, the leading end portion of the lead-off sheet $S_1$ is being nipped between the pair of conveying rollers 116. In its trailing end portion, the lead-off sheet $S_1$ is only subjected to the weights of the other sheets on the belt. The sheet $S_1$ at its trailing end is not nipped between the pair of conveyance blocking rollers 114 and therefore, under the relation of expression (1) above, only the lead-off sheet $S_1$ is fed by the pair of conveying rollers 116 with the other sheets $S_2$, $S_3$, . . . remaining left on the stopped belt 115. At the timing after the lapse of a predetermined time $t_7$ whereat the lead-off sheet $S_1$ has passed between the pair of conveying rollers 116, the motor M116 is stopped (step S108) and the brake force for the motor M114 is released (step S109). Next, if the set number of sheets are not yet finished, the belt 115 and the pair of conveyance blocking rollers 114 are operated for a time $t_8$ required to feed the sheet by a distance d corresponding to the spacing d (steps S111 and S112). Thereby the state of FIG. 19 is restored (but the sheet $S_2$ has come to the position of the sheet $S_1$), and the belt 115 and the pair of conveyance blocking rollers 114 become braked and stand by for the feeding of the sheet $S_2$.

Figure 22:
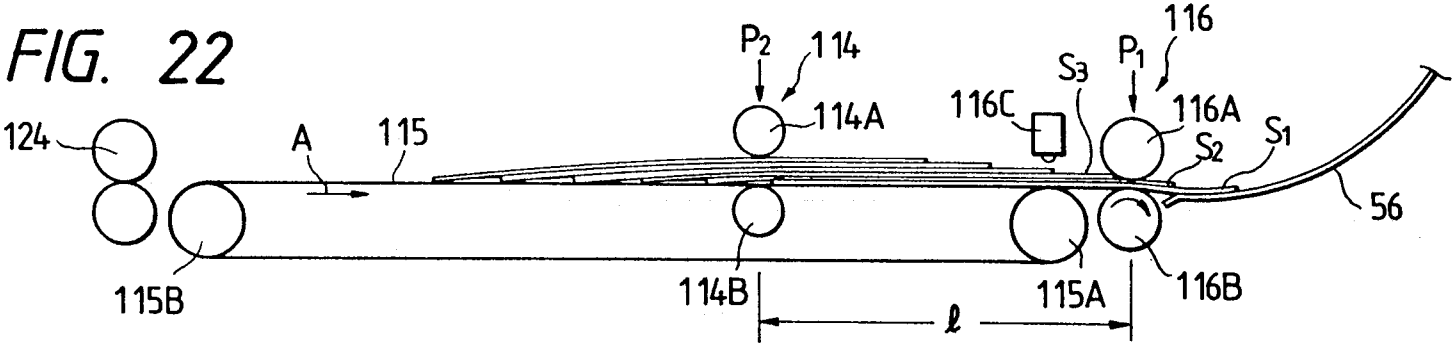
FIG. 22 illustrates the operation of the third embodiment of the present invention.

FIG. 22 shows a case where sheets are longer than ones of the smallest size in the previous example. Again in this case, as in the case of the sheets of the smallest size in the previous example shown in FIG. 19, by pre-recognizing the length of the sheets, the belt 115, the pair of conveyance blocking rollers 114 and the pair of conveying rollers 116 are once stopped at the timing whereat the trailing end edge of the lead-off sheet $S_1$ has passed between the pair of conveyance blocking rollers 114. The basic control of the operation is similar to the flow chart of FIG. 21. However, it is necessary that the amount of conveyance required for the trailing end edge of the lead-off sheet $S_1$ to pass between the pair of rollers 114 be increased correspondingly to the greater length of the sheets. Accordingly, the time $\Delta t$ of step S103 becomes greater.

Because the length of the sheets is greater than the length of the sheets of the smallest size in the previous example, in addition to the lead-off sheet $S_1$, several sheets such as the second and third sheets superposed thereon are nipped between the pair of conveying rollers 116 at this time (the number of such nipped sheets is varied by the length of the sheets and the spacing between the sheets). That is, the distance between the pair of rollers 114 and the pair of rollers 116 is shorter than the length of the sheets minus the amount of deviation.

When the conveying roller 116B is started by the exclusive motor 116 with the belt remaining stopped, the drive force $\mu_1P_1$ of the conveying roller 116B, the resistance force $\mu_3P_1$ due to the friction between the lead-off sheet $S_1$ and the second sheet $S_2$ superposed thereon and the resistance force due to the weight of the sheets act on the lead-off sheet $S_1$, but since the resistance force due to the sheets can be almost neglected, said two forces $\mu_1P_1$ and $\mu_3P_1$ act on the lead-off sheet $S_1$. The relation between these two forces is such that from the aforementioned expression (1), the force $\mu_1P_1$ is greater than the force $\mu_3P_1$ and therefore, the lead-off sheet $S_1$ is fed by the conveying roller 116B.

On the other hand, the second sheet superposed on the lead-off sheet being fed is subjected to a tractive force $\mu_3P_1$ in the direction of conveyance from the lead-off sheet by the pair of conveying rollers 116, but is held down with a force $\mu_2P_2$ by the pair of conveyance blocking rollers 114 acting on the stopped belt. The relation between these two forces is such that from the aforementioned expression (1), the force $\mu_2P_2$ is greater than the force $\mu_3P_1$ and therefore, the second sheet stays at the same position without moving with the lead-off sheet. Further, even if the rotation of the conveying roller 116B is continued after the trailing end edge of the lead-off sheet has passed between the pair of conveying rollers 116, the second sheet is not moved even if directly subjected to the drive force of the conveying roller 116A because in expression (1), the force $\mu_2P_2$ is greater than the force $\mu_1P_1$.

As in the case of the aforedescribed sheets of the smallest size, the second and subsequent sheets are then successively fed by moving the belt and the pair of conveyance blocking rollers 114 by the spacing d between the sheets, and the standby condition for the feeding of the next sheet is entered. Thus, even if the sheets are longer than the set distance l, they can be reliably fed one by one.

Figure 24:
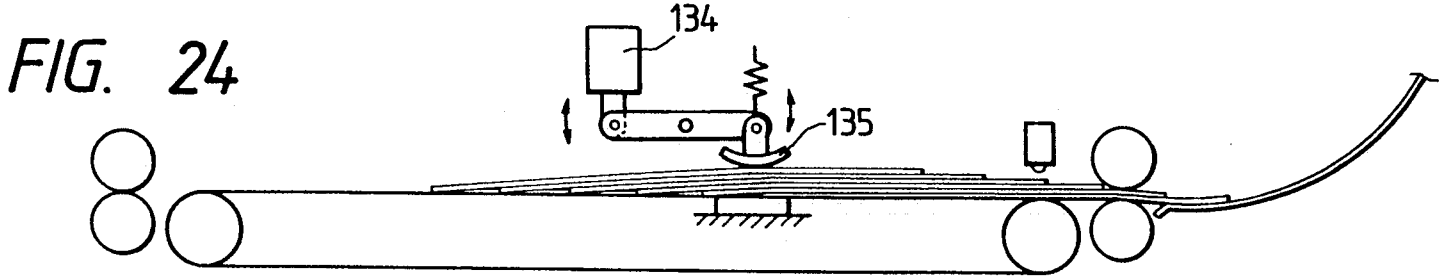
FIG. 24 shows a fifth embodiment of the present invention.

The conveyance blocking means only need hold down the piled sheets against movement at a predetermined timing with a force stronger than the conveying force of the pair of conveying rollers 116, and need not always be rotatable members such as rollers, but may be plate-like or bar-like fixed members. Also, it will suffice if such fixed members can change over the sheets between their nipped state and their released state at a predetermined timing, and for example, use may be made of a construction as shown in FIG. 24 wherein a plate-like keep member 135 is urged and released by a solenoid 136. The supporting and conveying means need not always be a belt, but may be a construction comprising one or more pairs of rollers.

Figure 23:
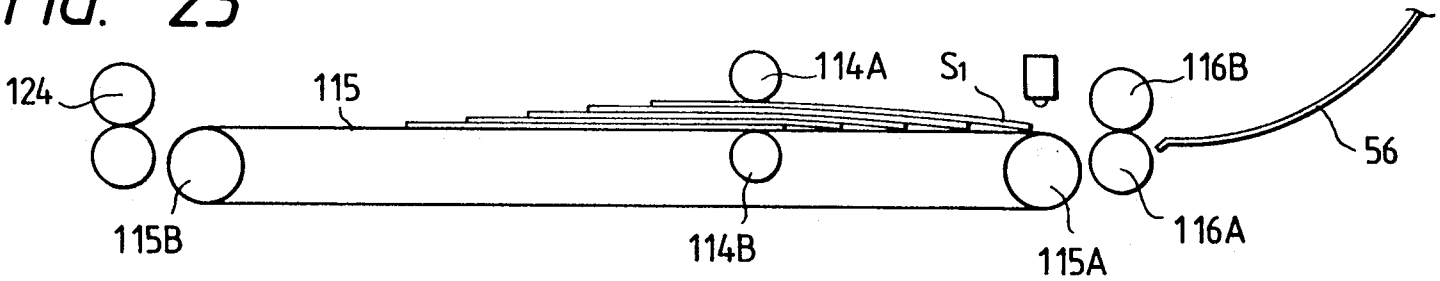
FIG. 23 shows a fourth embodiment of the present invention.

In the above-described embodiments, there has been shown the case of sheets set back one by one with respect to the forward direction of conveyance and piled, but in the case of a bundle of sheets set forward with the sheets to be superposed later being advanced with respect to the forward direction of conveyance as shown as another embodiment in FIG. 23, the drive side roller 116B of the pair of conveying rollers may be disposed on the opposite side as shown to thereby obtain an effect similar to that described previously.

The above two embodiments have been shown as applications in a both-surface image forming apparatus, whereas the present invention is not restricted thereto, but is also applicable to an intermediate tray in other apparatus such as a both-surface reading apparatus.

Figure 25:
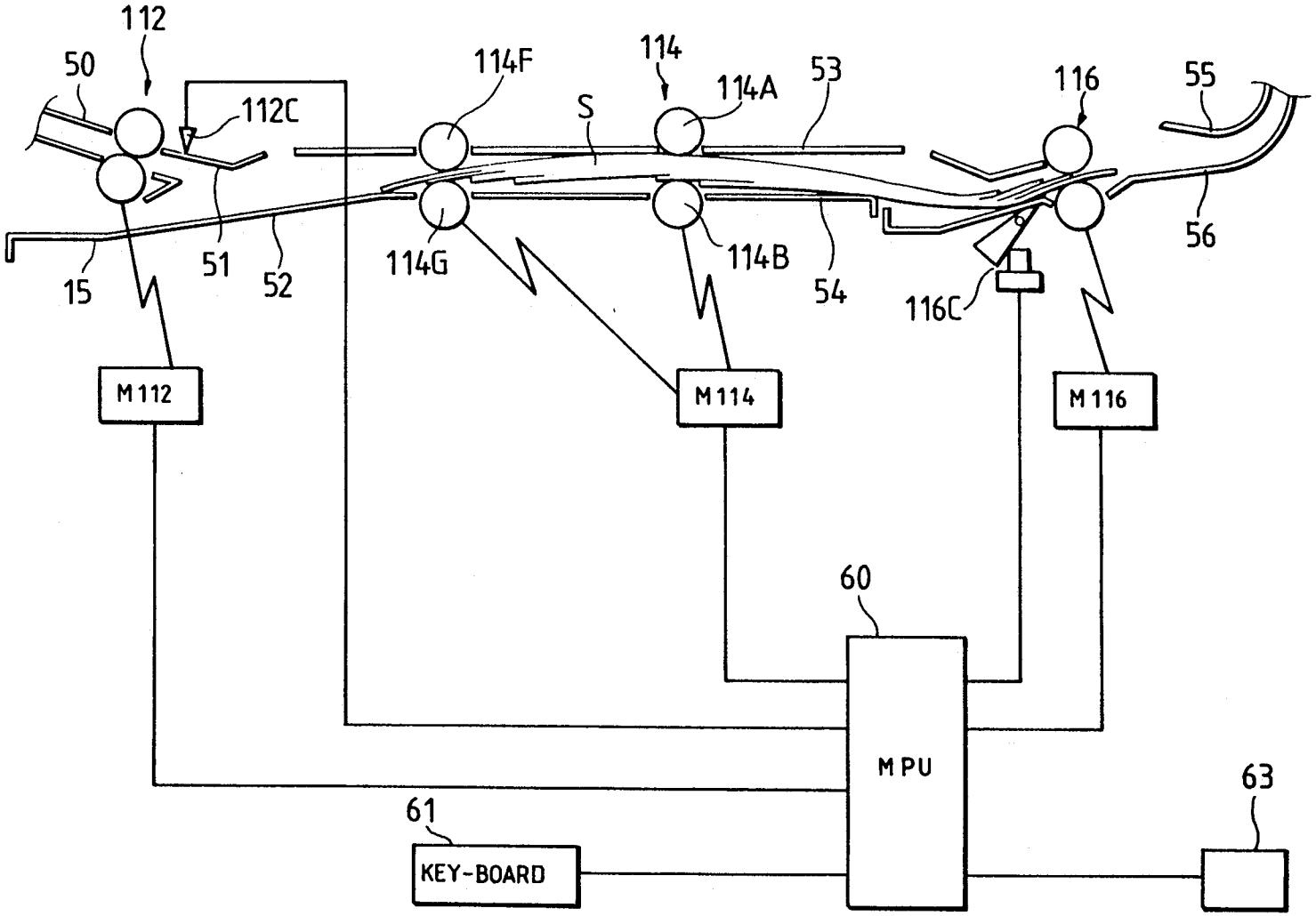
FIG. 25 shows a sixth embodiment of the present invention.

FIG. 25 shows still another embodiment of the present invention. The construction of FIG. 25 is nearly the same as that shown in FIG. 4, and is applicable in the image forming apparatus shown in FIG. 1.

The difference of the construction of FIG. 25 from that of FIG. 1 is that a pair of rollers 114F and 114G are added. The roller 114G is driven by the motor M114 and is rotated in synchronism with the roller 114B. The roller 114F, like the roller 114A, is urged against the roller 114G with a predetermined biasing force.

The operation of the present embodiment is the same as that shown in FIG. 4, and is controlled in accordance with the flow charts shown in FIGS. 5, 9, 11, 15 and 17. Conveying means corresponding to the pair of rollers 114 of FIG. 4 are provided at two spaced apart locations, whereby the number of sheets piled with a predetermined amount of deviation provided therebetween can be increased. If such pairs of rollers are further increased, the number of piled sheets can be further increased.

What is claimed is:

1. A sheet conveying apparatus having:

piling means for piling sheets with a predetermined amount of deviation in the direction of conveyance therebetween:

conveying means for nipping plural sheets including a lead-off sheet among the sheets piled with predetermined deviation and applying conveying force to a surface of the lead-off sheet which is not contacted with other sheets;

movement restricting means disposed upstream of said conveying means by a distance shorter than the predetermined length of the conveyed predetermined sheet for restricting the movement of the sheets other than the lead-off sheet, said movement restricting means not carrying out the movement restriction while the lead-off sheet is passing therethrough.

2. A sheet conveying apparatus according to claim 1, wherein said first conveying means includes a driving rotational member rotatable in contact with that surface of the lead-off sheet which is not in contact with the other sheets and imparting a conveying force thereto.

3. A sheet conveying apparatus according to claim 2, wherein said first conveying means includes a follower rotational member cooperating with said driving rotational member to nip the sheets therebetween.

4. A sheet conveying apparatus according to claim 1, further including second conveying means for conveying the piled sheets to said first conveying means.

5. A sheet conveying apparatus according to claim 4, wherein said second conveying means includes a belt for supporting sheets thereon and conveying them.

6. A sheet conveying apparatus according to claim 1, wherein said movement restricting means includes a rotational member adapted to contact with the sheets and rotatable with the movement of the sheets, and means for restricting the rotation of said rotational member.

7. A sheet conveying apparatus according to claim 1, wherein the movement restricting force caused by said movement restricting means to act on the sheets is greater than the conveying force caused by said first conveying means to act on the sheets.

8. A sheet conveying apparatus according to claim 1, wherein said movement restricting means includes pressing means for pressing the sheets.

9. A sheet conveying apparatus having:

piling means for piling sheets with a predetermined amount of deviation in the direction of conveyance therebetween;

conveying means for nipping plural sheets including a lead-off sheet among the sheets piled with predetermined deviation and applying a conveying force to only that surface of the lead-off sheet which is not contacted with other sheets;

movement restricting means disposed upstream of said conveying means for nipping the sheets and restricting the movement thereof; and control means for controlling said movement restricting means so as to carry out the movement restriction of the sheet nipped by said conveying means selectively, said control means carrying out control so that the movement restriction is not carried out while the lead-off sheet among sheets nipped by said conveying means is passing through said movement restricting means.

10. A sheet conveying apparatus according to claim 9, wherein said conveying means includes a drive roller rotatable in contact with that surface of the lead-off sheet which is not in contact with the other sheets, thereby imparting a conveying force thereto.

11. A sheet conveying apparatus according to claim 9, wherein the movement restricting force caused by said movement restricting means to act on the sheets is greater than the conveying force caused by said conveying means to act on the sheets.

12. A sheet conveying apparatus having:

piling means for piling sheets successively with a predetermined amount of deviation in the direction of conveyance provided therebetween;

first conveying means for nipping the sheets piled with the predetermined amount of deviation provided therebetween and imparting a conveying force to the lead-off one of the sheets;

second conveying means capable of nipping the sheets piled by said piling means between it and said first conveying means and conveying them in forward and reverse directions; and control means for controlling said second conveying means so as to feed the sheets to said first conveying means, and convey the other sheets than the lead-off sheet in the reverse direction after the lead-off sheet has been liberated from its nipped condition.

13. A sheet conveying apparatus according to claim 12, wherein said first conveying means is provided with a rotational member rotatable in contact with the lead-off sheet to thereby impart a conveying force to the lead-off sheet.

14. A sheet conveying apparatus according to claim 13, wherein said control means controls said second conveying means so that if images are formed on those surfaces of the sheets which are in contact with said rotational member, the other sheets than the lead-off sheet are conveyed in the reverse direction when said first conveying means is conveying the lead-off sheet.

15. A sheet conveying apparatus according to claim 13, wherein said control means controls said second conveying means so that if images are formed on the surfaces of the sheets opposite to the surfaces which are in contact with said rotational member, the other sheets than the lead-off sheet are conveyed in the reverse direction before said first conveying means conveys the lead-off sheet.

16. A sheet conveying method characterized by the steps of:

piling sheets successively with a predetermined amount of deviation in the direction of conveyance therebetween;

nipping plural sheets including a lead-off sheet among sheets piled with predetermined deviation and applying conveying force of the conveying direction onto a surface of the lead-off sheet which is not contacted with other sheets;

applying conveying force to the sheets other than the lead-off sheet among said nipped sheets of the direction reverse to the conveying direction at an upstream side than the position where the conveying force is applied to the lead-off sheet.

17. A sheet conveying method according to claim 16 wherein if an image is formed on that surface of the lead-off sheet which is contact with the other sheets, the other sheets than the lead-off one of the piled sheets are conveyed in the direction opposite to the direction of conveyance while a conveying force in the direction of conveyance is imparted to the lead-off sheet.

18. A sheet conveying method according to claim 16, wherein if an image is formed on the surface of the lead-off sheet opposite to the surface which is in contact with the other sheets, the other sheets than the lead-off one of the piled sheets are conveyed in the direction opposite to the direction of conveyance before a conveying force in the direction of conveyance is imparted to the lead-off sheet.

19. An image forming apparatus having:

image forming means for forming an image on one surface of each of sheets;

feeding means for feeding the sheets one by one to said image forming means;

piling means for piling the sheets each having an image formed on one surface thereof by said image forming means with a predetermined amount of deviation in the direction of conveyance therebetween;

first conveying means for nipping plural sheets including the lead-off sheet amoung sheets piled with the predetermined deviation and applying a conveying force to a surface of the lead-off sheet which is not contacted with other sheets;

second conveying means for conveying the sheets from said piling means to said first conveying means;

movement restricting means disposed upstream of said first conveying means by a distance shorter than the conveyed sheets for restricting movement of the sheets;

control means for controlling said movement restricting means so as to carry out the movement restriction of the sheets nipped by said first conveying means selectively, said controlling means carrying out control so that the movement restriction is not carried out while the lead-off sheet is passing through said movement restricting means;

a conveyance path for directing the sheet to which the conveying force is applied by said first conveying means to said image forming means.

20. An image forming apparatus according to claim 19, further having change-over means for changing over whether the image bearing surface of the sheet having an image formed on one surface thereof by said image forming means should face upward or downward.

21. An image forming apparatus according to claim 19, wherein said movement restricting means is disposed upstream of said first conveying means by a distance shorter than the conveyed sheets.

22. An image forming apparatus according to claim 19, wherein the movement restricting force caused by said movement restricting means to act on the sheets is greater than the conveying force caused by said first conveying means to act on the sheets.

23. An image forming apparatus having:

image forming means for forming an image on one surface of each of sheets;

feeding means for feeding the sheets one by one to said image forming means;

piling means for piling the sheets each having an image formed on one surface thereof by said image forming means with a predetermined amount of deviation in the direction of conveyance therebetween;

first conveying means for nipping the sheets piled with the predetermined amount of deviation therebetween and imparting a conveying force to the lead-off sheet;

second conveying means for nipping the sheets piled by said piling means between it and said first conveying means and conveying them in forward and reverse directions;

control means for controlling said second conveying means and conveying the sheets other than the lead-off sheet in the reverse direction after the lead-off sheet has been released from its nipped condition; and a conveyance path for directing the sheet to which the conveying force is applied by said first conveying means to said image forming means.

24. A sheet conveying apparatus according to claim 23, wherein said control means controls said second conveying means so that if images are formed on those surfaces of the sheets which are in contact with said rotational member, the sheets other than the lead-off sheet are conveyed in the reverse direction when said first conveying means is conveying the lead-off sheet.

25. A sheet conveying apparatus according to claim 23, wherein said control means controls said second conveying means so that if images are formed on the surfaces of the sheets opposite to the surfaces which are in contact with said rotational member, the sheets other than the lead-off sheet are conveyed in the reverse direction before said first conveying means conveys the lead-off sheet.

* * * * *

UNITED STATES PATENT AND TRADEMARK OFFICE

CERTIFICATE OF CORRECTION

PATENT NO. :5,008,713

DATED :April 16, 1991

INVENTOR(S) :OZAWA, ET AL.

It is certified that error appears in the above-identified patent and that said Letters Patent is hereby corrected as shown below:

FIG. 9:

"STOPED" (both occurrences) should read --STOPPED--.

FIG. 11:

"STOPED" should read --STOPPED--.

FIG. 15:

"STOPED" (all three occurrences) should read --STOPPED--.

FIG. 21:

"STOPED" (both occurrences) should read --STOPPED--.

UNITED STATES PATENT AND TRADEMARK OFFICE

CERTIFICATE OF CORRECTION

PATENT NO. : 5,008,713

DATED : April 16, 1991

INVENTOR(S) : OZAWA, ET AL

It is certified that error appears in the above-identified patent and that said Letters Patent is hereby corrected as shown below:

COLUMN 3:

Line 59, "s" should read --show--.

COLUMN 7:

Line 45, "150$mm_2$" should read --150 $mm^2$--.
Line 51, "2$mm_2$" should read --2 $mm^2$--.

Signed and Sealed this

Thirteenth Day of October, 1992

*Attest:*

*Attesting Officer*

DOUGLAS B. COMER

*Acting Commissioner of Patents and Trademarks*